US007780236B2

(12) United States Patent
Bergkvist

(10) Patent No.: US 7,780,236 B2
(45) Date of Patent: Aug. 24, 2010

(54) BOUNCING CRADLE

(75) Inventor: Håkan Bergkvist, Bromma (SE)

(73) Assignee: BabyBjörn AB, Solna (SE)

( * ) Notice: Subject to any disclaimer, the term of this patent is extended or adjusted under 35 U.S.C. 154(b) by 39 days.

(21) Appl. No.: 12/303,519

(22) PCT Filed: Jul. 6, 2007

(86) PCT No.: PCT/SE2007/000676

§ 371 (c)(1),
(2), (4) Date: Dec. 4, 2008

(87) PCT Pub. No.: WO2008/004959

PCT Pub. Date: Jan. 10, 2008

(65) Prior Publication Data

US 2009/0256408 A1 Oct. 15, 2009

(30) Foreign Application Priority Data

Jul. 7, 2006 (SE) ..... 0601501

(51) Int. Cl.
*A47D 1/02* (2006.01)

(52) U.S. Cl. ..... 297/354.12; 297/369; 297/256.13

(58) Field of Classification Search ..... 297/DIG. 11, 297/364, 365, 376, 377, 354.12, 256.13, 297/369
See application file for complete search history.

(56) References Cited

U.S. PATENT DOCUMENTS

| | | | | |
|---|---|---|---|---|
| 1,168,112 | A * | 1/1916 | Rockwell | 217/60 D |
| 2,281,209 | A * | 4/1942 | Smith | 5/618 |
| 3,096,963 | A * | 7/1963 | Welsh | 248/576 |
| 5,451,095 | A | 9/1995 | Riback | |
| 5,507,564 | A | 4/1996 | Huang et al. | |

* cited by examiner

*Primary Examiner*—Sarah B McPartlin
(74) *Attorney, Agent, or Firm*—Dickstein Shapiro LLP

(57) ABSTRACT

A bouncing cradle comprising a base frame (10), a backrest (20), a first pivot mounting (12) arranged for the backrest (20) and carried by the base frame (10), an arm (22) fixedly connected to the backrest (20) and situated under the backrest (20) as well as at a distance from the first pivot mounting (12), the arm being, via a second pivot mounting (22, 23), connected to an adjustment fitting (40), the adjustment fitting (40) having at least two recesses (51, 52) that are situated at different distances from the second pivot mounting (22, 23) and that can receive a bar (14) carried by the base frame (10) and situated at a distance from the first pivot mounting, for setting different angles of inclination of the backrest (20) in relation to the base frame (10), the bar (14), the arm (22) and the first and the second mounting (12, 22) being axially parallel and the base frame (10) being intended to stand on a substantially horizontal underlay. The adjustment fitting (40) has a through elongate opening (60) having a side (61), which is turned obliquely downward and facing the first pivot mounting and in which the recesses (51, 52, 53) are situated. Each recess (51-53) has a bottom part (62) that supportingly receives the bar (14), and a mouth portion (63) that, obliquely downward and toward the first pivot mounting, mouths into the opening (60).

5 Claims, 5 Drawing Sheets

BOUNCING CRADLE

The invention relates to a bouncing cradle, or bouncy chair comprising a base frame, a backrest, a first pivot mounting carried by the backrest and carried by the base frame, and an arm fixedly connected to the backrest and situated under the backrest as well as at a distance from the first pivot mounting. The arm is connected, via a second pivot mounting, to an adjustment fitting. The adjustment fitting has at least two recesses that are situated at different distances from the second pivot mounting and that can receive a bar carried by the base frame and situated at a distance from the first pivot mounting, for setting different angles of inclination of the backrest in relation to the base frame. The bar, the arm and the first and the second mounting are axially parallel and the base frame is intended to stand on a substantially horizontal underlay.

Thus, the invention relates to a bouncing cradle (children's reclining chair) of the kind that comprises a base frame, which is intended to rest on a plane underlay, a backrest, for a first pivot mounting arranged for the backrest and carried by the base frame, an arm fixedly connected to the backrest and situated under the backrest as well as at a distance from the first pivot mounting, the arm being, via a second pivot mounting, connected to an adjustment fitting 40, which has at least two recesses that are situated at different distances from the second pivot mounting and that can receive a bar carried by the base frame, for setting different angles of inclination of the backrest in relation to the base frame, the bar, the arm and the pivot mountings being axially parallel. By bringing different recesses into engagement with the bar, it is possible to set a number of preselected inclination positions of the backrest, for instance inclination positions that are suitable for a number of different things to do for the child, such as play, rest, sleep.

An object of the invention is to provide a bouncing cradle, which easily and with high safety can be readjusted between said inclination positions.

An additional object is to provide a bouncing cradle that also upon lifting in the backrest retains the set inclination position of the backrest in relation to the base frame.

An additional object is to provide a construction that affords folding of the backrest substantially parallel to the base frame into a transportation position, as well as detachable securing of the backrest and the base frame in the transportation position.

An additional object is to provide a bouncing cradle that, after conversion from the transportation position into the using state, automatically, upon load, assumes a stable inclination position of the backrest.

An additional object is to provide a bouncing cradle that has a locking device, which upon actuation allows the conversion of the bouncing cradle between the transportation state and the using state.

Further other objects and advantages of the invention are defined directly or indirectly in the following the description.

The objects are entirely or partly attained by the invention.

The invention provides a bouncing cradle comprising a base frame, a backrest, a first pivot mounting carried by the backrest and carried by the base frame, and an arm fixedly connected to the backrest and situated under the backrest as well as at a distance from the first pivot mounting. The arm is connected, via a second pivot mounting, to an adjustment fitting. The adjustment fitting has at least two recesses that are situated at different distances from the second pivot mounting and that can receive a bar carried by the base frame and situated at a distance from the first pivot mounting, for setting different angles of inclination of the backrest in relation to the base frame. The bar, the arm and the first and the second pivot mounting are axially parallel and the base frame is intended to stand on a substantially horizontal underlay. The adjustment fitting has a through elongate opening having a side which is turned obliquely downward and faces the first pivot mounting. The recesses are situated such that each recess has a bottom part that supportingly receives the bar, and a mouth portion that, obliquely downward and toward the first pivot mounting, mouths into the opening.

Embodiments of the invention are defined in the appended dependent claims.

In the following, an embodiment of the invention will be described, reference being made to the appended drawing.

FIG. 1 schematically and in perspective shows a bouncing cradle.

(In FIG. 1, the bag is shown not fully pulled on, for reasons of lucidity. On the cloth bag, a pair of cloth trousers is shown, into which the child should be put down).

Figure 1:
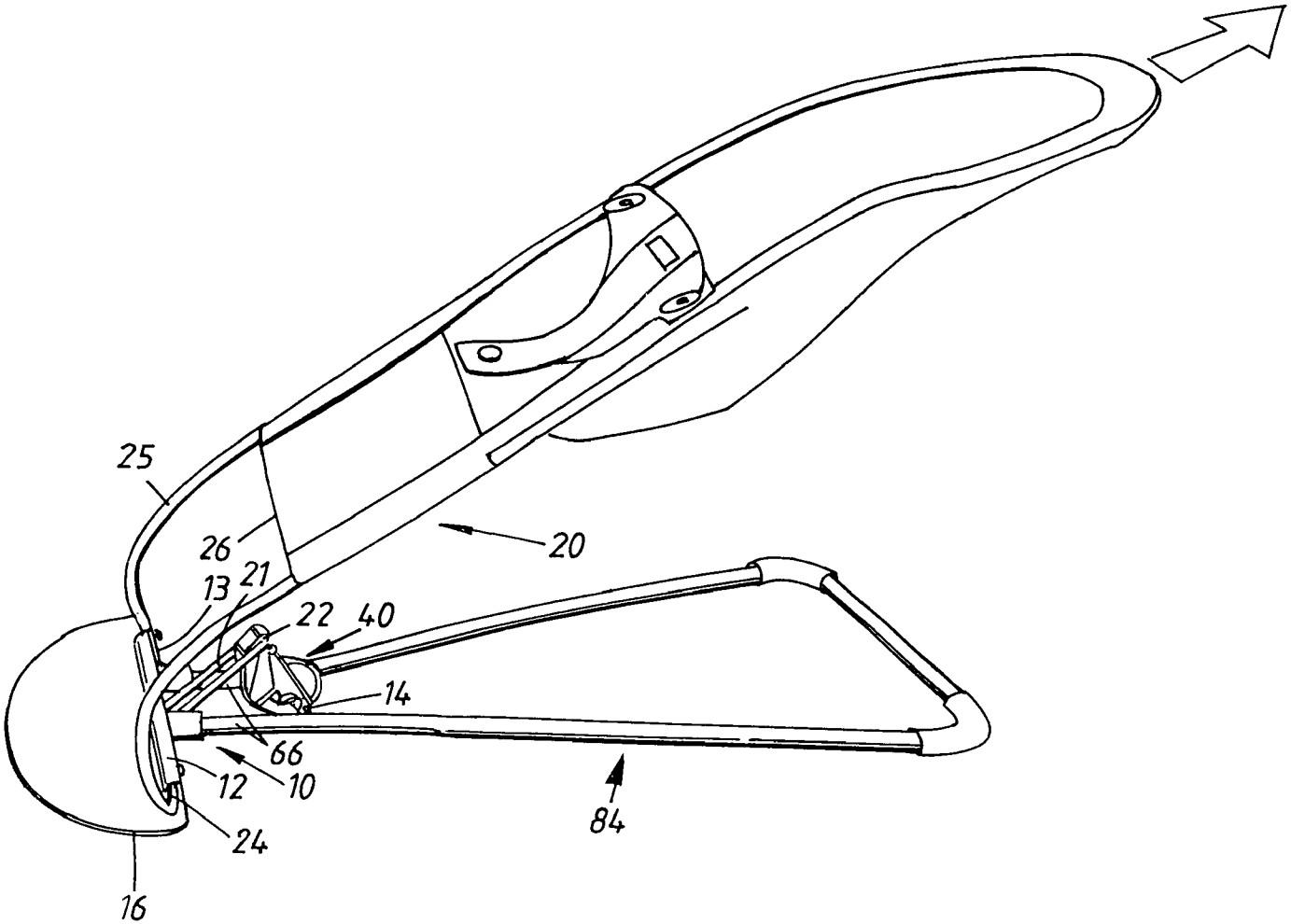
FIG. 1 illustrates a bouncing cradle comprising a backrest 20, which is formed of a generally U-shaped frame part 25 on which a cloth bag is to be pulled on so as to form a reclining support for an infant.

The backrest frame 25 is supplemented by two straight and axially aligned frame pieces 24 and a generally U-shaped yoke integratedly attached between the same.

The frame pieces 24 are received in a pivot mounting 12 along a straight edge 13 of a support plate 16 belonging to a base frame 10, which is intended to stably rest on a horizontal underlay. An essentially flat yoke of a generally triangular nature has the free ends 66 thereof parallel to and attached in the support plate. At a distance from the ends 66, the yoke is widened so as to form two support points, which are laterally spaced-apart in relation to the backrest 20. Said two support points may be established by friction material applied on the underside of the yoke in the corner areas of the yoke between the web and the branches. The support plate 16 may, on the underside along the circumference border thereof, be provided with a strand of friction material, for instance rubber, as anti-skid protection.

It can be seen that a bar 14 extends between the yoke ends 66, the bar 16 being received in the respective hole in the yoke end parts.

An adjustment fitting 40 has a pivot mounting 23 for the web part 22 of the U-shaped part of the backrest frame.

Figure 2:
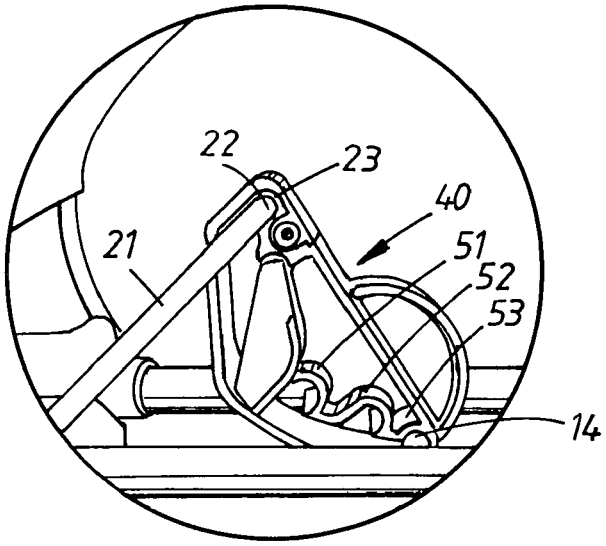
FIG. 2 shows an enlarged depiction of a detail of the bouncing cradle according to FIG. 1, comprising an inclination adjustment fitting.
Figure 6:
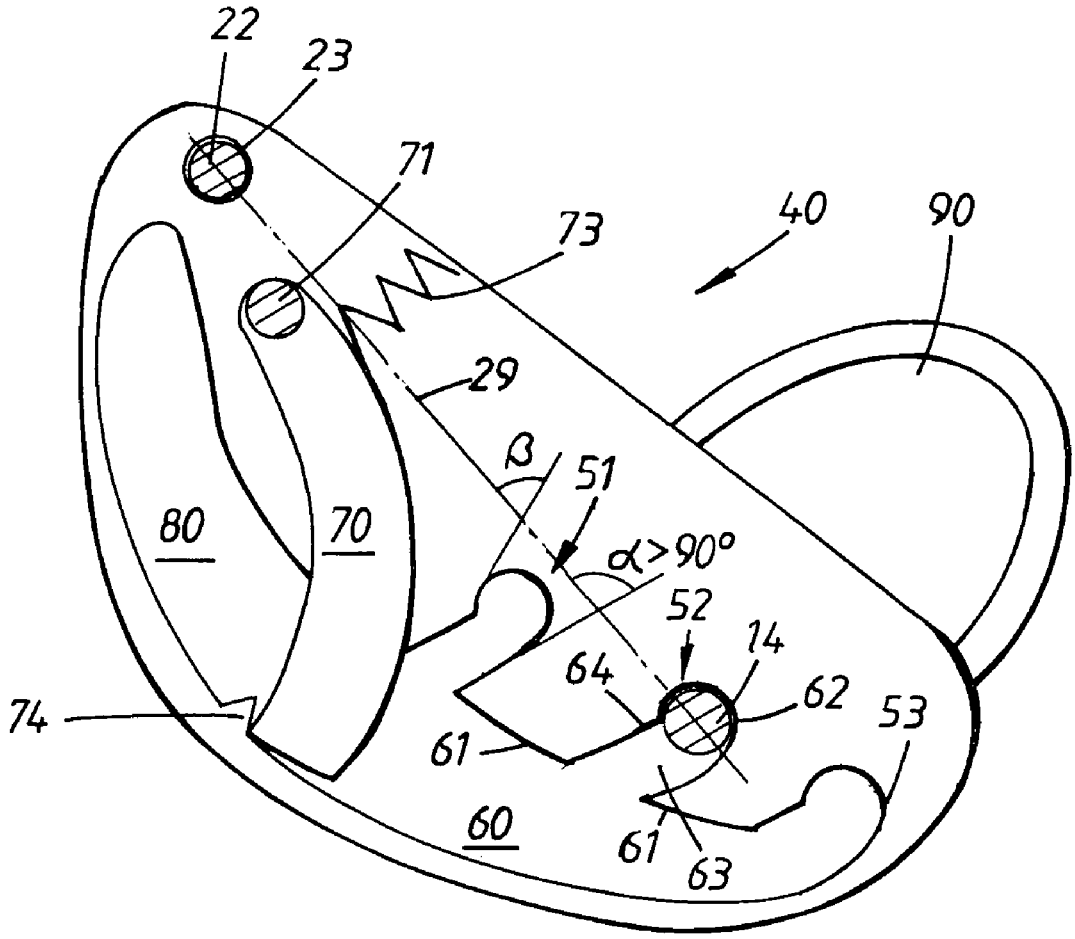
FIG. 6 shows a broken-away side view of the adjustment fitting.

From FIGS. 2 and 6, it can be understood that the bar 14 and the arm 22 are approximately at the same distance from the pivot mounting 12, and that the adjustment fitting 40 has an elongate opening 60 having a side 60, which is turned obliquely downward and facing the first pivot mounting 12 and in which recesses 51, 52, 53 are situated. Each recess has a bottom part 62 that supports the bar 14, and a mouth portion 63 that, obliquely downward and toward the first pivot mounting, mouths in the opening 60. The bar 14, the arm 22 and the pivot mountings 12, 23 are axially parallel.

The elongate opening 60 is delimited toward the upper end thereof by a locking arm 70, which is pivotally mounted around a spindle 71 in the vicinity of the pivot mounting 23, and is biased by a spring 72 toward the end position shown.

By the inclinations accounted for, the bar 14 can always, from the opening 60, slide on surfaces inclined to the vertical into the bottom portion 62 of a recess, when the backrest is loaded vertically. From FIG. 6, it is possible to further see that the mouth portion 63 of the recess has a width that is greater than the diameter of the bar 14, and that the bottom portion 62 of the recess at the upper part thereof is undercut in order to stably receive the bar 14 and prevent the bar 14 from sliding out of the recess, when the backrest is vertically loaded, independently of which recess the bar 14 is received in.

From FIG. 6, it can be seen that the locking arm 70 in the shown end position thereof, by the side thereof facing the opening 60, intersects the upper mouth wall of the recess 51 and forms a guide surface for the introduction of the bar 14 from the opening 60 into the mouth part of the recess 51.

By means of a bias spring 73, the locking arm 70 is biased against a stopper 74. The arm 70 can be turned manually against the action of the spring 73 and, in doing so, brings the opening 60 in communication with an additional elongate opening 80 in the fitting 40, the opening 80 extending up to the area of the pivot mounting 23.

Figure 3:
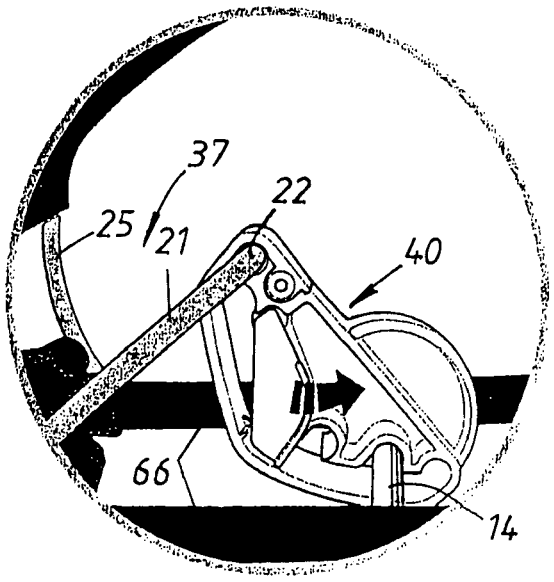
FIGS. 3, 4, 5 show in depictions corresponding to FIG. 2, different rotary positions of the adjustment fitting upon transition from an inclination-determining using position, into a transportation position of the bouncing cradle.
Figure 4:
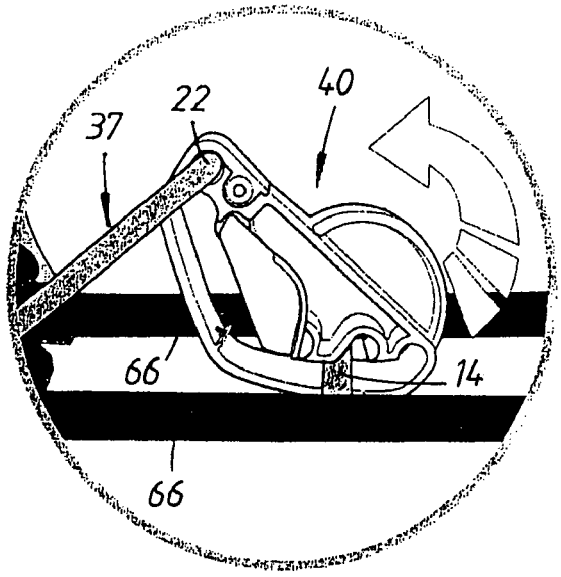
Figure 5:
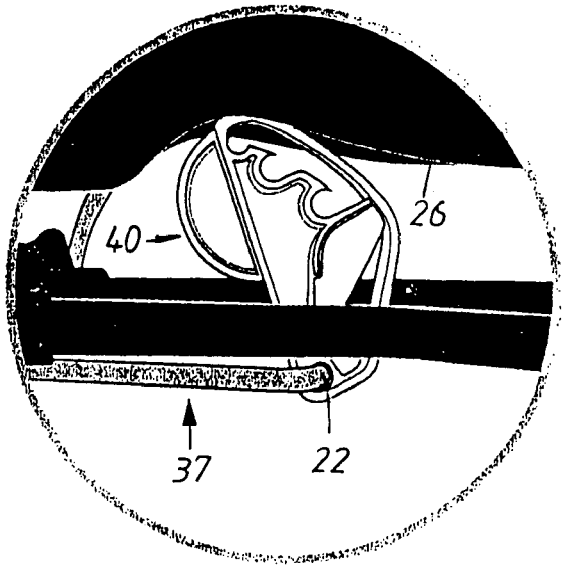

Furthermore, it can be seen that on the outside thereof, the fitting 40 has a gripping ear 90, which facilitates manual turning of the fitting 40 around the mounting 22, 23. FIG. 3 illustrates that the bar 14 is in the recess 52, and that it is desirable to convert the bouncing cradle into a transportation position in which the backrest is generally parallel and next to the base frame 10. In doing so, the locking arm 70 is turned back against the action of the spring 73 in the direction of the arrow indicated in FIG. 3, so that the fitting 40 can be turned in such a manner that the bar 14 leaves the recess 52 and runs along the opening 60 and inward toward the opening 80, such as is indicated by the arrow in FIG. 4. Upon continued turning of the fitting 40 around the mounting 22, 23, the turning motion of the fitting 40 is continued according to FIG. 4 until the fitting 40 assumes the position shown in FIG. 5, in which the pivot mounting 23 is situated in the vicinity of the bar 14 (not shown), the bouncing cradle having assumed the transportation position. In the transportation position, the U-yoke part 37 extends at an angle under the plane of the base frame 10, and the web 22 thereof is situated on a level under the bar 14.

Figure 7:
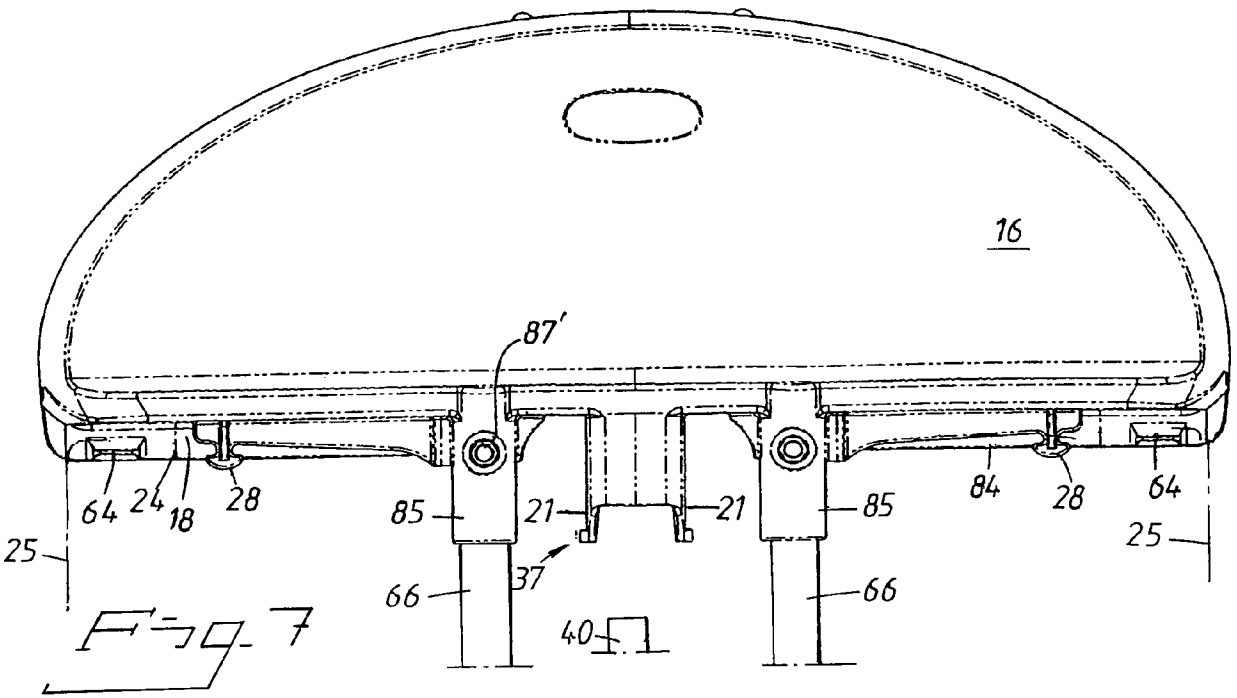
FIG. 7 shows a planar view of a support plate belonging to the base frame.

FIG. 7 illustrates that the support plate 16 has a pair of integrated sleeves 85, which receive the ends 66 of the yoke 84. Furthermore, it is seen that the sleeves 85 as well as the yoke ends 66 have vertically aligned through holes, and that a bolt joint extends therethrough. The bolt joint is shown to have a nut at the top and has a screw head at the bottom. The straight front edge 13 of the support plate has a groove that receives the straight frame pieces 24. The U-yoke part 37, the bottom web of which forms the arm 22, is carried by the frame pieces 24 via the pair of arms 21.

The screw heads 86 of the bolt joints confine the straight frame pieces 24 in the grooves in the support plate 16. The integrated sleeves 85 afford a stable high-strength connection to the support plate 16, and afford, by means of the bolt joints, a simple connection of the yoke 84 to the support plate 16. From FIG. 7, it is possible to further see that the support plate has integrated buttons 28 that, in addition to confining the frame pieces 24, also afford anchorage of the lower border part of the bag that is threaded onto the frame part 25 for the formation of the backrest 20. In that connection, the front part of the bag has buttonhole openings in alignment with the buttons 28, whereby a stable anchorage of the bag in the stretched state is attained.

Figure 8:
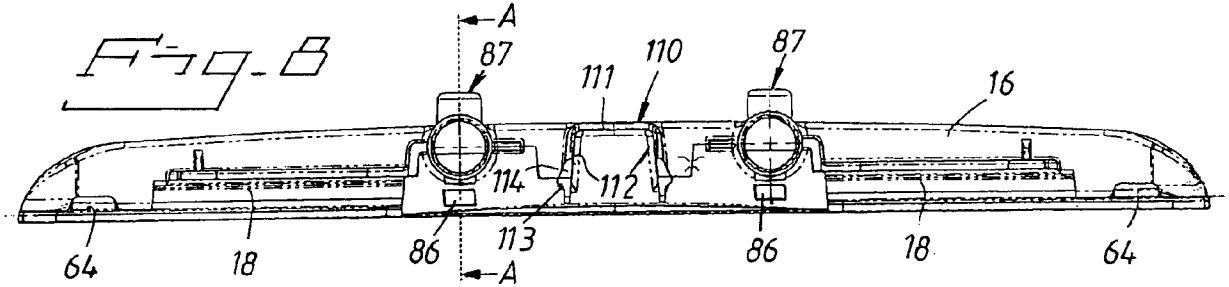
FIG. 8 shows a view taken along the line VIII-VIII in FIG. 7.

From FIGS. 7 and 8, it can be seen that the support plate 16 has a projecting U-girder 110, which is situated between the sleeves 85 and is integrated with the injection-moulded support plate 16. The bottom web 111 of the girder 110 is situated at the topside of the support plate, and the branches 112 thereof extend downward therefrom. The distance between the outsides of the branches is somewhat smaller than the free distance between the branch arms 21 of the U-yoke 37. In this way, the U-yoke 37 is centred and thereby the backrest 20 in relation to the base frame, when the U-yoke is turned down over the U-girder. By the fact that the free branch ends of the girder 110 have generally wedge-shaped protuberances 114 at least at the free end of the girder, an interference between said protuberances 114 and the arms 21 is afforded, and the arms 21 are locked detachably under said protuberances 114 when the arms 21 have passed past them. The branches 112 are elastically resilient and also allow, thanks to a wedge 113, a turning back of the U-yoke piece 37 past the arms 21, so that the branches are driven toward each other upon the turning back of the U-yoke 37 away from the transportation position. That is, the branch ends having the wedges 113, 114 form a detachable catch for the retention of the backrest next to the base frame in the transportation position.

Finally, from FIG. 6, it can be understood that the recesses 51, 52, 53 allow free passage of the bar 14 to and from the bottom portion 62, with the exception of a small dog 64 possibly being arranged at the transition between the mouth portion 63 and bottom part 62 of the recess in the upper wall of the recess. Said dog 64 forms, together with the opposite recess wall, a waist that is somewhat smaller than the diameter of the bar 14. Thanks to an elastic resiliency of the opposite walls of the recess in the vicinity of said dog 64, a snap-locking function is afforded that blocks the bar 14 from unintentionally leaving the bottom part 62 of the recess. The undercut of the upper side wall of the recess in the bottom part serves to guarantee that the bar 14 cannot leave the recess upon loading of the backrest in the direction of the base frame.

The upper side wall of the recess leans at an angle $\beta<90°$ to the line 29 between the centres of the bar 14 and of the arm part 22. The lower side wall of the recess leans, as is seen from FIG. 6, at an angle $\alpha>90°$ to the line 29.

By the fact that the upper wall of the elongate opening 60 has a substantial inclination to the horizontal, independently of the position of the bar 14 along the opening 60, the bar 14 will be able to slide along the upper smooth opening wall, when the backrest is loaded. When the bar 14 then is introduced into a recess 52, 53, the bar will 14 easily slide along the upper smooth mouth wall of the recess, which also has a substantial inclination to the horizontal, and passes into the bottom part 62 of the recess. Hence, the bar 14 automatically makes for one of the recesses 51-53 upon loading of the backrest.

Figure 9:
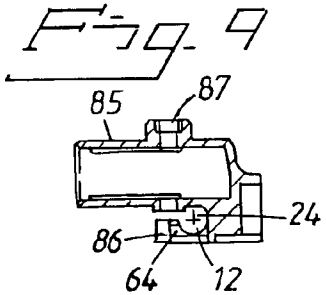
FIG. 9 shows a section taken along the line A-A in FIG. 8.

From FIGS. 7-9, it is possible to further see that each sleeve 85 has a nut socket 87, which rotationally secures a lock nut that receives a through screw, the head of which radially projects from the diametrically opposed side of the sleeve and screens off the groove in order to locally restrain a straight frame piece 24 therein. At the other end of the frame piece, the same is restrained in the groove by a respective dog 64. The screw is suitably of the Allen-type and the nut 87 is suitably a lock nut having friction inserts.

The invention claimed is:

1. A bouncing cradle comprising a base frame (10), a backrest (20), a first pivot mounting (12) carried by the backrest (20) and carried by the base frame (10), an arm (22) fixedly connected to the backrest (20) and situated under the backrest (20) as well as at a distance from the first pivot mounting (12), the arm being, via a second pivot mounting (22, 23), connected to an adjustment fitting (40), the adjustment fitting (40) having at least two recesses (51, 52) that are situated at different distances from the second pivot mounting (22, 23) and that can receive a bar (14) carried by the base frame (10), the bar being situated at a distance from the first pivot mounting, for setting different angles of inclination of the backrest (20) in relation to the base frame (10), the bar (14), the arm (22) and the first and the second pivot mounting (12, 22) being axially parallel and the base frame (10) being intended to stand on a substantially horizontal underlay, characterized in that the adjustment fitting (40) has a through elongate opening (60) having a side (61), which is turned obliquely downward and facing the first pivot mounting and in which the recesses (51, 52, 53) are situated, that each recess (51-53) has a bottom part (62) that supportingly receives the bar (14), and a mouth portion (63) that, obliquely downward and toward the first pivot mounting, mouths into the opening (60).

2. Bouncing cradle according to claim 1, characterized in that a wall of the mouth portion of each recess that is facing the first pivot mounting forms an angle of less than 90° to a line through the axes of the bar (14) and of the second pivot mounting (22, 23), and that a bottom portion at an opposite wall of the recess is undercut.

3. Bouncing cradle according to claim 1, characterized in that the opening (60) is delimited by a locking arm (70) that is turnably mounted on the adjustment fitting (40) and spring biased against an end position in which it delimits the opening (60) toward the second pivot mounting (22, 23), and that the locking arm is possible to turn away against the action of the spring bias, whereby the opening (60) is brought in communication with an additional elongate opening (80) that extends up to an area of the second pivot mounting (22, 23).

4. Bouncing cradle according to claim 3, characterized in that the locking arm (70) is formed in order to, on the side thereof facing the opening (60), guide a shank of the bar (14) from the opening into an adjacent recess (51).

5. Bouncing cradle according to claim 3, characterized in that the locking arm (70) is arranged to, upon turning away, be turned into an area of the opening (60), and then blocks an adjacent recess (51) so that the bar (14) has to be situated in some one of the other recesses (52, 53) in order to allow the locking arm to be turned away and allow the bar to be moved into said additional opening (80).

* * * * *